US005183242A

United States Patent [19]

Crimmins et al.

[11] Patent Number: 5,183,242

[45] Date of Patent: Feb. 2, 1993

[54] METHOD AND APPARATUS FOR FEEDING SHEETS

[75] Inventors: Robert A. Crimmins, Algonquin; Michael D. Flasza, Schaumburg, both of Ill.

[73] Assignee: D&K Custom Machine Design, Inc., Elk Grove Village, Ill.

[21] Appl. No.: 752,395

[22] Filed: Aug. 30, 1991

[51] Int. Cl.[5] ..... B65H 5/08

[52] U.S. Cl. ..... 271/14; 271/93

[58] Field of Search ..... 271/5, 11, 14, 91, 93; 414/797

[56] References Cited

U.S. PATENT DOCUMENTS

| | | | |
|---|---|---|---|
| 2,815,948 | 12/1957 | Watter | 271/14 |
| 3,070,367 | 12/1962 | Schwebel | 271/93 |
| 3,411,640 | 11/1968 | Wallis | 271/91 |
| 4,470,589 | 9/1984 | Singer | 271/11 |
| 4,732,376 | 3/1988 | Umezawa | 271/14 |

*Primary Examiner*—H. Grant Skaggs
*Attorney, Agent, or Firm*—Wallenstein, Wagner & Hattis, Ltd.

[57] ABSTRACT

A sheet feeding apparatus (10) and method are disclosed that are fast, efficient, easy to set up and involve a minimum number of components. The sheet feeding mechanism (10) includes a first gripping member (20) comprised of two first suction cups (21) and a second gripping member (40) comprised of two second suction cups (41). The first suction cups (21) are moved along a first path (P1) between a first position and a second position by a first guide means (25). The second suction cups (41) are moved along a second path (P2) between a third position and a fourth position by a second guide means (60). Vacuum means (22,42) are connected to the suction cups (21,41) for picking up, holding and releasing sheets (TS). The first suction cups (21) pick up a sheet (TS) and transfer it to the second suction cups (41) which take the sheet (TS) to a lamination unit (LU1,-LU2).

24 Claims, 5 Drawing Sheets

METHOD AND APPARATUS FOR FEEDING SHEETS

TECHNICAL FIELD

The present invention relates generally to laminating machines and, more particularly, to a novel sheet feeding assembly and method that are fast, efficient, easy to set up and involve a minimum number of components.

BACKGROUND PRIOR ART

Today, there are numerous uses and applications of laminated products. Such products typically include a sheet of paper disposed between two sheets of film. Examples of such products include menus, book covers, presentation folders, boxes, video cassette cases, record and CD jackets and displays for stores. Prior to lamination, the sheets that are to be laminated are often precut and stacked. Once stacked, the sheets are individually fed by a sheet feeder to a lamination unit. An example of such a method and sheet feeder is shown in U.S. Pat. No. 4,470,589, which is owned by the Assignee of the present invention, D&K CUSTOM MACHINE DESIGN, INC., Elk Grove Village, Ill. Successful double lamination machines and methods are also disclosed in U.S. Pat. Nos. 4,743,334, 5,019,203 and U.S. Ser. No. 421,241 Attorney Docket No. 251 P 040, all owned by D&K CUSTOM MACHINE DESIGN, INC.

SUMMARY OF THE INVENTION

According to the present invention, a sheet feeding mechanism and method is disclosed. The sheet feeding assembly includes a platform for supporting a stack of sheets that is movable in the vertical direction relative to both an external and an internal frame structure. The internal frame structure is movable relative to the external frame structure so as to accommodate sheets of different sizes.

A first gripping member having first vacuum means for holding an exposed top sheet is connected to the internal support structure. This first gripping member is movable along a generally vertical path by first guide means between a first position and a second position in a first direction holding the top sheet and in a second direction without holding the top sheet. First switch means for turning the first vacuum means ON and OFF is also provided.

A second gripping member having second vacuum means for holding a sheet is also connected to the internal support structure. This second gripper member is movable along a generally horizontal path by second guide means between a third position and a fourth position in a first direction holding the top sheet and in a second direction without holding the top sheet. Second switch means for turning the second vacuum means ON and OFF is also provided.

According to another aspect of the present invention, the first gripper member is at least two horizontally parallel first suction cups that are movable in unison between the first and second positions. These first suction cups have a common first vacuum source connected to them. Also, the second gripper member is at least two horizontally parallel second suction cups that are movable in unison between the third and fourth positions. As with the first suction cups, the second suction cups have a common second vacuum source connected to them.

According to a further aspect of the present invention, the first guide means includes means for driving at least two air cylinders and at least two generally vertical piston rods. Each rod is connected adjacent one end to one of the first suction cups and cooperating at the opposite end with one of the air cylinders. Thus, the first suction cups are in their first positions when the piston rods are extended from the air cylinders and in their second positions when the piston rods are retracted into the air cylinders. The second guide means includes an eccentric. The eccentric has a step motor for driving a rotating wheel member. A link is pivotally interconnected adjacent one end to the wheel member, defining a rotating member-link interconnection, and interconnected adjacent the other end to a reciprocating block. The reciprocating block slides forward and backward on two generally horizontal stationary guide rods. Thus, the second suction cups are in their third positions when the distance between the rotating member-link interconnection and the guide rod is the greatest and in their fourth positions when the distance between the rotating member-link interconnection and the guide rods is the smallest.

The sheet feeder mechanism also includes means for adjusting the vertical positioning of the air cylinders and means for adjusting the vertical positioning of the second suction cups. Additionally, the feeder has means for adjusting the horizontal positioning of the reciprocating block and means for adjusting the horizontal positioning of the first cups so as to accommodate sheets of different widths. Moreover, means are also provided for adjusting the horizontal spacing between the first suction cups and the second suction cups.

According to the method of the present invention both vacuum the switches and both the guide means are coordinated so as to perform a cycle. The cycle is:

1) positioning the first suction cups in their first position with the first vacuum means ON so as to take hold of the exposed top sheet while moving the second suction cups from their fourth position to their third position with the second vacuum means OFF;

2) moving the first suction cups to their second position with the first vacuum means ON so as to be holding the top sheet while moving the second suction cups from their fourth position to their third position with the second vacuum means OFF;

3) positioning the first suction cups in their second position with the first vacuum means ON so as to be holding the top sheet while positioning the second suction cups in their third position with the second vacuum means OFF;

4) turning the first vacuum means OFF so as to release the top sheet from their first suction cups while at about the same time turning the second vacuum means ON so as to have the second suction cups take hold of the top sheet;

5) positioning the first suction cups in the second position with the first vacuum means OFF while moving the second suction cups from their third position to their fourth position with the second vacuum means ON so as to be holding the top sheet;

6) moving the first suction cups from their second position to their first position and turning the first vacuum means ON while positioning the second suction cups in their fourth position and turning the second vacuum means OFF; and, 7) positioning the first suction cups in their first position with the first vacuum means ON so as to take hold of a newly exposed top sheet while moving the second suction cups from their fourth position to their third position with the second vacuum means OFF.

Other advantages and aspects of the present invention will become apparent upon reading the following description of the drawings and detailed description of the invention.

DETAILED DESCRIPTION

Figure 1:
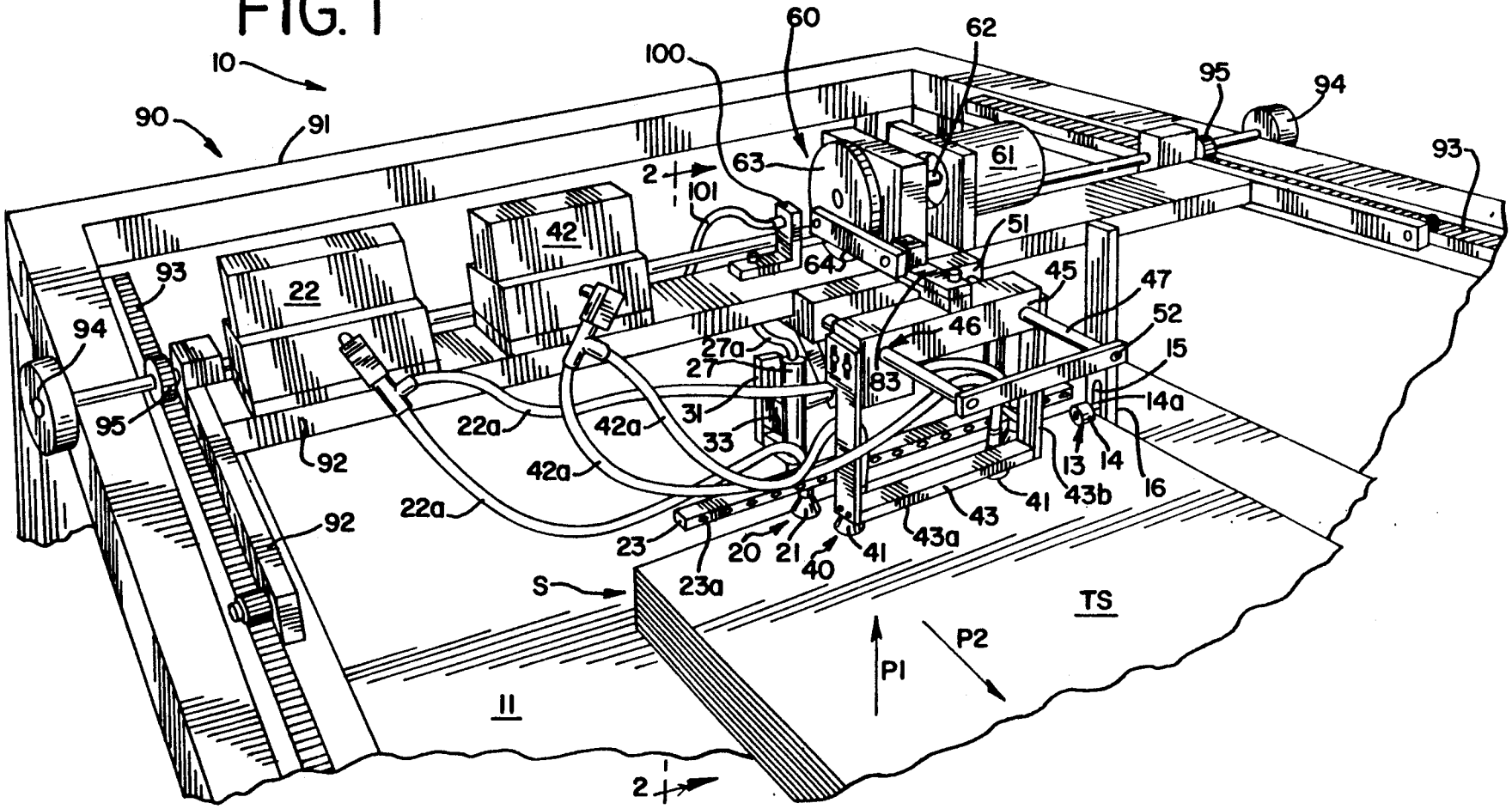
FIG. 1 is a top perspective view of the sheet feeding mechanism of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

The apparatus of the present invention, designated by reference numeral 10, is illustrated generally in FIG. 1. This apparatus continuously and efficiently feeds sheets, one at a time, along a path both upwardly and frontwardly from a stack to a lamination machine (not shown).

In particular, the apparatus includes a frame 90 that has two primary components, an exterior support structure 91 and a movable interior support structure 92. Parallel racks 93 on the side members of the exterior support structure 91 cooperate with a control wheels 94 and pinions 95 attached to the interior support structure 92 so as to permit longitudinal movement, backwards and forwards, of the interior support structure 92 relative to the exterior support structure 91. Thus, the longitudinal placement of the entire interior support structure 92 can be controlled by turning the control wheels 94. This is particularly advantageous when working with sheets of different length. For example, the internal frame structure 92 can be positioned in a first location when it is to feed sheets having a length of 10 inches, positioned in a second location when it is to feed sheets having a length of 20 inches and so on.

The exterior support structure or exterior frame 91 supports a platform or bin 11 that has a substantially flat, horizontal upper surface and is vertically-movable and adjustable. A stack of sheets S is placed on the platform 11 and held down and generally in place by a stop 13 positioned on the top sheet TS adjacent the rear edge of the stack of sheets S. While the figures show one stop adjacent a side of the stack S, it is appreciated that more than one stop 13 can be used. For example, two stops 13 can be used on the stack S with one adjacent each side. The stop 13 comprises a weighted member 14, preferably cylindrical, having an extension **14*a* at one end threaded through a slot 15 and interconnected to a weight frame 16 positioned adjacent a side of the stack S. If desired, the weight frame 16 can have an L-shaped cross-section so as to abut both the side edge and the rear edge of the stack S; this prevents the sheets from sliding sideways off the stack or rearwardly off the stack. The top of the weight frame 16 is connected to the interior support structure 92. The connection of the extension 14*a* to the weight frame 14*a* is made such that the weight 14 is vertically slidable in the slot 15. Accordingly, as the stack of sheets S moves vertically (both upwardly and downwardly), the weight 14** on the stack moves with it.

Figure 3:
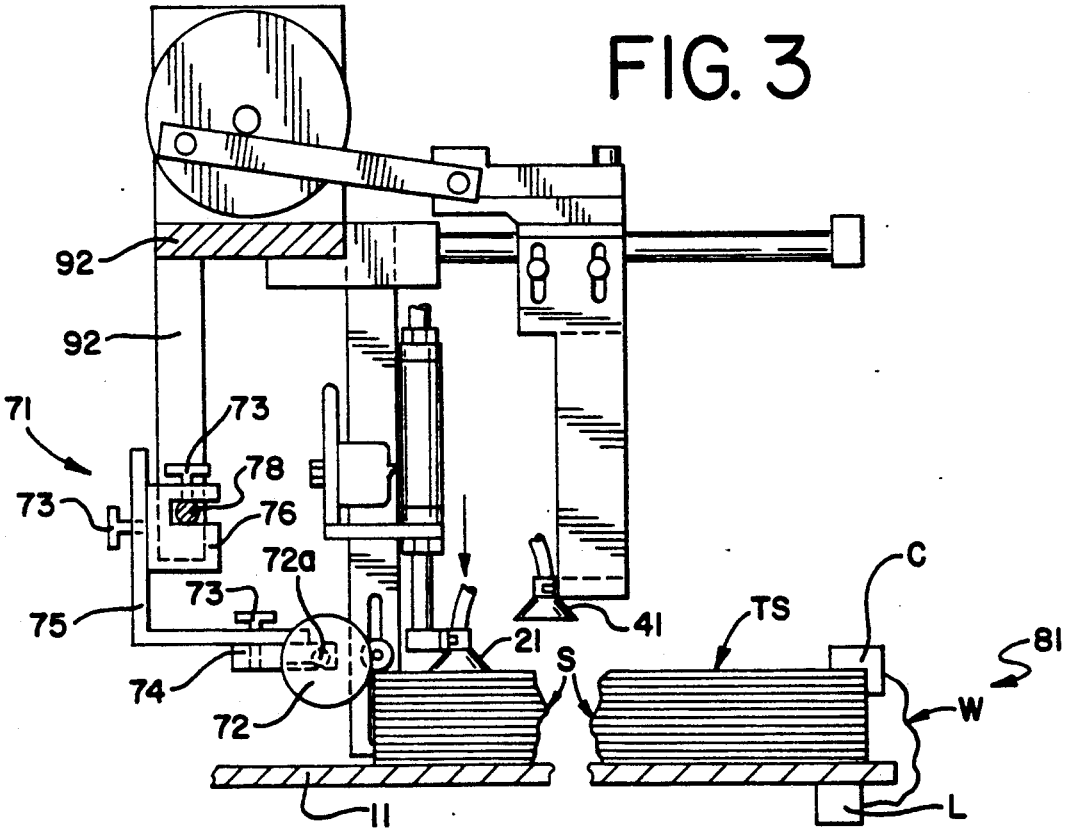
FIG. 3 is the same view as shown in FIG. 2 but highlighting additional components.

Two additional features of the present invention are shown separately in FIG. 3. In particular, FIG. 3 shows the brush assembly 71 and a schematic representation of the platform lift assembly 81.

The brush assembly 71 is removable and aids in separating the top sheet TS from the stack S and comprises a course cylindrical brush that is connected to a L-bracket member 75 which, in turn, is connected to the interior support structure 92. The brush 72 has a central shaft **72*a* that is connected to a brush mount 74. The brush mount has internal threading for receiving the external threading on the projection of an adjustment knob 73. The L-bracket member 75 has a horizontal portion with a centrally located elongated horizontal slot therein and a vertical portion with a centrally located vertical slot therein. The projection of the tightening knob 73 fits into the horizontal slot of the L-bracket member 75. Thus, by tightening the knob 73 into the mount 74, the L-bracket member is frictionally engaged between the mount 74 and the head portion of the tightening knob 73; by loosening the knob, the mount and the brush 72** can be moved horizontally to the desired position.

The interior support structure 92 has a horizontal rod 78 (shown in cross-section in FIG. 3) rigidly secured thereto. A C-bracket member 76 is secured to this rod 78 by a tightening knob 73. The end of the threaded projection of the tightening knob 73 frictionally engages the rod 78. Consequently, so as to accommodate sheets S of different widths, the C-bracket member 76 can be positioned and secured anywhere along the rod 78. The C-bracket member 76 is secured to the L-bracket member 75 in the same manner as the mount 74 is secured to the L-bracket member. The projection of the tightening knob 73 fits into the vertical slot of the L-bracket member 75. Thus, by tightening the knob 73 into the C-bracket member 76, the L-bracket member is frictionally engaged between the C-bracket member 76 and the head portion of the tightening knob 73; by loosening the knob, the L-bracket member and the brush 72 can be moved vertically to the desired position.

In practice, it is desired to position the brush 73 so that it abuts rear edge of the top sheet TS and adjacent sheets below the top sheet of the stack of sheets S in a manner such that the top sheet and other sheets are each interposed between two or more bristols of the brush. With this arrangement, when the top sheet TS is lifted, the bristles of the brush 73 deflect with the top sheet keeping it separated from the adjacent sheet. Experimentation has shown that the sheets separate more easily and stay separated more frequently when the brush 73 is prevented from rotating.

The platform can also be made to automatically move upwardly as the stack of sheets S decreases. Shown schematically in FIG. 3 at the front end of the stack of sheets S, a sensor C, and more particularly, a switch hook, is positioned for sensing the height of the stack. A wire W connects the sensor C to a lift L which mechanically lifts the platform 11 upwardly. Thus, for example, after a few sheets are removed from the stack S, the switch hook C is no longer in contact with the sheets and, as a result, will turn a switch ON, sending a signal through the wire W to cause the lift L to raise the platform 11. The platform lifts the stack S until the top sheet TS engages the switch hook C, which turns the switch OFF, thereby causing the lift L to stop. This process is repeated throughout the sheet feeding process.

The apparatus includes a first gripping member or first gripping means 20 for moving the sheets, one at a time, along a first, generally vertical, path P1. Specifically, the first gripping member comprises a pair of first suction cups 21 that have vacuum means attached to them and that are movable between a first, home position to a second, transfer position. The cups 21 are preferably aligned horizontal and parallel to one another. The vacuum means connected to the first suction cups 21 comprises a common vacuum source 22 and vacuum lines **22*a* disposed between each cup 21 and the source 22**.

The first suction cups 21 preferably move in unison along the first path P1. This is accomplished by a first guide means that both supports and moves the first gripping members 20 along the generally vertical path P1. The first guide means includes a first support member 23 which is a generally horizontal bar member with a plurality of openings **23*a* in its front face. Each first suction cup 21 is held by bracket means 24 that is fastened to the first support member 23 by a pair of fasteners. The pair of fasteners cooperate with a pair of openings 23*a* in the horizontal bar 23. Thus, by having the multiple openings 23*a* in the bar 23, the horizontal spacing between the first suction cups 21 is adjustable. One need only move the pair of fasteners, with the connecting bracket means 24 and the cup 21, from one pair of openings 23*a* in the bar 23 to another set of openings. Accordingly, in practice, the initial positioning and distance between the first suction cups 21** are set in the manner just described so as to accommodate sheets of different widths.

Figure 2:
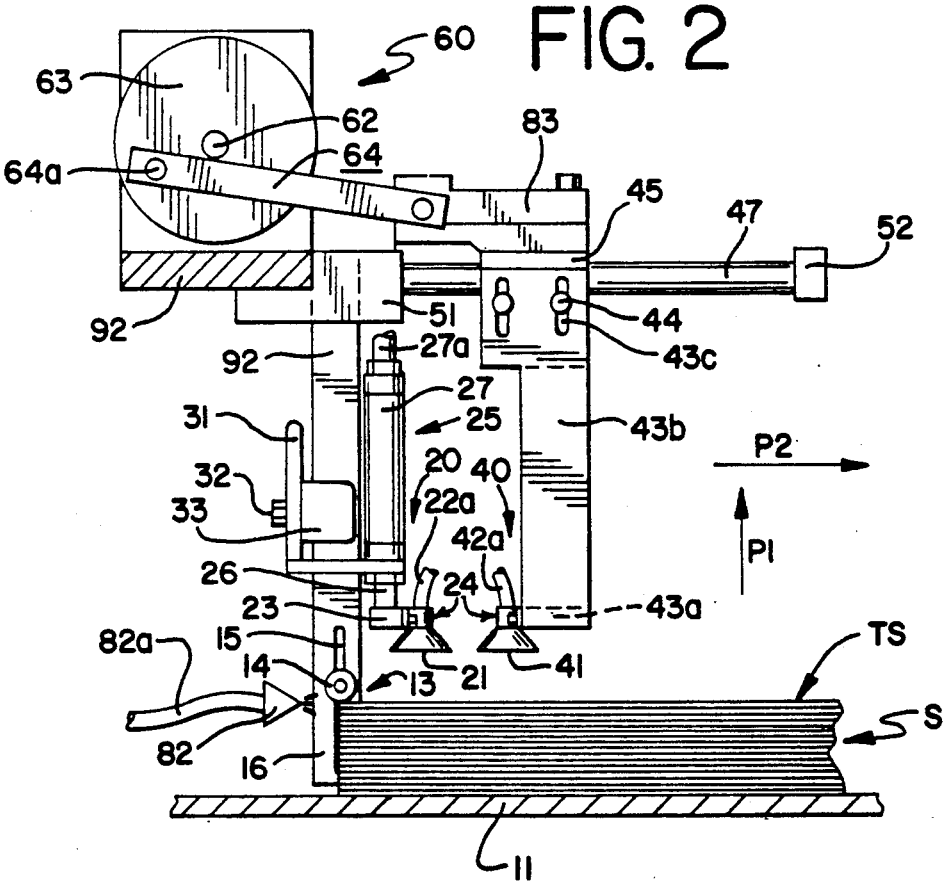
FIG. 2 is a side sectional view of the mechanism as viewed along line 2—2 of FIG. 1.

The first support member 23 is connected to a pair of pistons 25, more particularly to the outer ends of a pair of substantially vertical piston rods 26, each extending from a fluid chamber 27 (FIG. 2). The pistons 25 are used to lift and lower the first support member 23 and connected first suction cups 21. Consequently, it is the driven fluid cylinders 27 and the interconnected piston rods 26 that move the first suction cups 21 between a first position (when the piston rods are fully extended from the fluid cylinders) to a second, transfer position (when the piston rods are retracted into the fluid cylinders). The fluid cylinder are connected to fluid lines **27*a* and driven by conventional pneumatic or hydraulic means. In practice, it has been found that using air as the fluid for driving the air cylinders 27** works extremely well.

The initial vertical positioning of the pistons 25 is also easily adjustable in order to accommodate different stack heights of sheets S. In particular, each fluid cylinder 27 is secured to an L-bracket 31 having an elongated vertical slot within its vertical wall portion. A clamping assembly having a tightening knob 32 with a threaded projecting that fits through the vertical slot of the L-bracket 31 is received by an aperture in an elongated block 33. The L-bracket 31 is thusly frictionally engaged between the tightened knob 32 and the elongated block 33. Of course, it is recognized that a single L-bracket with two or more vertical slots can be used in place of multiple L-brackets, each with a slot. The elongated block 33 is connected to the interior support structure or interior frame 92. With this assembly, the vertical positioning of each fluid cylinder 27 is adjusted by loosening the knob 32, moving the cylinder 27 and retightening the knob.

The apparatus further includes a second gripping member or second gripping means 40 for moving the sheets, one at a time, along a second, generally horizontal, path P2. Specifically, the second gripping member comprises a pair of second suction cups 41 that have vacuum means attached to them and that are movable between a first, home and transfer position to a second position. The cups 41 are preferably aligned horizontal and parallel to one another. The vacuum means connected to the second suction cups 41 comprises a common vacuum source 42 and vacuum lines **42*a* disposed between each cup 41 and the source 42**.

As with the first suction cups 21, the second suction cups 41 preferably move in unison along the second path P2. This is accomplished by a second guide means that both supports and moves the second gripping members 40 along the generally horizontal path P2.

The second guide means includes second support member 43, which is a U-shaped member, having a generally horizontal bar member **43*a* with a plurality of openings (not shown) in its rear face and an upwardly projecting side member 43*b* connected at each side. Each second suction cup 41 is held by bracket means 24 (FIG. 2) that is fastened to the second support member 43 by a pair of fasteners. The pair of fasteners cooperate with a pair of openings (not shown), similar in construction to the ones in the horizontal bar 23*a* of first support member 23, in the horizontal bar member 43*a* of the U-shaped member 43. Thus, the horizontal spacing between the second suction cups 41 is adjustable. To accommodate sheets of different widths, the pair of fasteners, including the connecting bracket means 24 and the cup 41, can be removed from one pair of openings in the bar 32**, moved and refastened to another pair of openings.

The U-shaped second support member 43 is connected at the top of each upwardly projecting side member **43*b* to a reciprocating block 45. As shown in both FIGS. 1 and 2, a pair of parallel, substantially vertical slots 43*c* are provided in the upper portion of the side members 43*b* for receiving fastener means 44 that cooperate with corresponding openings (not shown) in the block 45 and frictionally hold the side members therebetween. In this manner, the initially vertical positioning of the second suction cups 41 can be adjusted by loosening the fastener means 44, sliding the upwardly projecting side members 43*b* up or down relative to the reciprocating block 45** to the desired vertical position and tightening the fastener means.

The reciprocating block 45 travels back and forth longitudinally along the path shown as P2 on a pair of parallel, substantially horizontal linear guide rods 47. This is accomplished by providing a pair of parallel, substantially horizontal longitudinal apertures 46 in the block 45 for receiving the linear guide rods 47. Each guide rod 47 is secured at one end to a mounting element 51, which, in turn, is secured to the interior frame 92. The distal ends of the guide rods 47 are connected to an end bar 52.

The reciprocating block 45 supporting the second suction cups 41 is driven by an eccentric 60. In particular, a step motor 61 rotates a shaft 62 that is connected to a driven circular wheel member 63. A link 64 is pivotally connected at one end to the wheel member 63 by a wheel pin 64*a*. At the other end, the link 64 is pivotally connected to the reciprocating block 45 via a connecting block 71. In short, the connecting block 71 interconnects the link 64 and the reciprocating block 45.

Thus, as the wheel 63 is rotated, it drives the reciprocating block 45 forwards and backwards on the guide rods 47 along a generally horizontal path P2. Consequently, the second suction cups 41 are in their first, home and transfer position when the distance between the pin 64*a* connecting the link 64 and the wheel 63 and the guide rods 47 is the greatest and the second suction cups are in their second position when the distance between the pin and the guide rods is the smallest.

A sensor 100 (FIG. 1) is positioned adjacent the wheel 63 so as to detect the presence of the wheel pin 64*a*. Thus, when the second suction cups have reached the home position (also called the second suction cup's first or transfer position) the sensor will send a signal by a wire 101 to a controller.

Turning to the two vacuum sources 22, 42, each has switch means to turn it OFF and to turn it ON. Thus, there is first switch means for turning the first vacuum source 22 ON and OFF, and second switch means for turning the second vacuum source 42 ON and OFF.

Additionally, an air nozzle 82 (FIG. 2) is provided adjacent the back edge of the stack S to provide a timed, synchronized jet stream of air. This nozzle 82 is connected to an air line 82*a*, an air source (not shown) and switching means (not shown) that turns it ON and OFF. The stream of air emitted from the nozzle 82 facilitates both in the separation of the top sheet TS of the stack of sheets S and in the transport of the top sheet TS by the second suction cups 41 frontwardly along the horizontal path P2. Specifically, the stream of air assists in preventing the sheets from sticking together as the top sheet TS is separated and moved vertically by the first suction cups 21. Also, the stream provides a cushion for the sheet TS as it is moved horizontally. The synchronizing of the air is shown in the timing diagram, FIG. 9.

As noted previously, the sheet feeding apparatus of the present invention removes a top sheet TS from the stack of sheets S, lifts it with the first gripper means 20 and moves it upwardly along a generally vertical path P1. The sheet TS is then transferred from the first gripper means 20 to the second gripper means 40. The second gripper means 40 then moves the sheet TS forwardly where it is transferred or taken to a laminating unit that laminates the various sheets. The initial, entry nip rollers for the laminating unit are shown schematically as LU1 and LU2 in FIG. 8.

The system is timed and coordinated so that while the second gripper means 40 is transporting the sheet TS forwardly from its home position to its second position or returning home from the second position, the first gripper means 20 moves downwardly, empty, and picks up the next exposed top sheet TS from the stack of sheets S. Thus, when the second gripper means 40 has returned home, a top sheet TS being held (in the up position) by the first gripper means 20.

Figure 9:
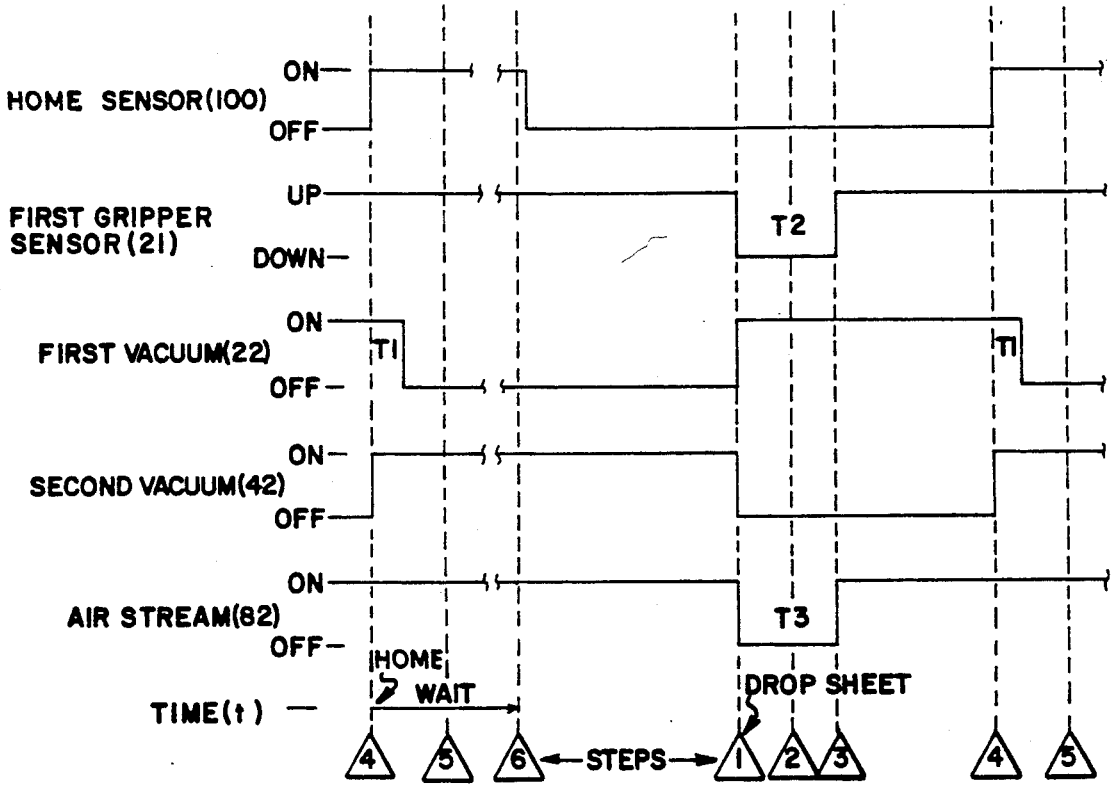

This sequence of the operation of the sheet feeding assembly is best understood with particular reference to the profile views shown in FIGS. 4–8 and the timing diagram in FIG. 9.

The assembly is first initialized by moving and setting the adjustable components previously described. For example, each of the following components is adjustable: the interior frame 92 relative to the exterior frame 91 and the stack of sheets S, the horizontal positioning of both sets of suction cups 21,41, the vertical positioning of both sets of suction cups 21,41, the vertical positioning of the weight 14, and the height of the table.

Additional components can be adjusted and the times of initiating certain activities and the duration of the activities can also be adjusted. For example, as shown in the timing diagram of FIG. 9, the point where the first gripper member 20 moves downwardly to pick up the sheet (Step 1 on time line) can be moved. The crucial considerations are (1) that the pick-up must be done after the sheet being moved forwardly by the second suction cups has cleared the path P1 of the first suction cups and (2) that the picked up sheet awaits the return home of the second suction cups. The times T1, T2 and T3 in FIG. 9 are all adjustable.

Prior to operating the sheet feeder, the operator must set the WAIT period. This is a pause built into the assembly so that the feeder does not rush ahead of the lamination unit. By way of illustration, if a sheet has a length L and it takes 3 units of time for the lamination unit to move it through the entry nip rollers LU1, LU2 and it takes 1 unit of time to pick up and feed the sheet to the entry nip rollers, the feeder must be stopped for 2 units of time. Otherwise, the sheets being fed to the lamination entry rollers would accumulate and pile up at the nip. This would, no doubt, jam the lamination unit.

Figure 8:
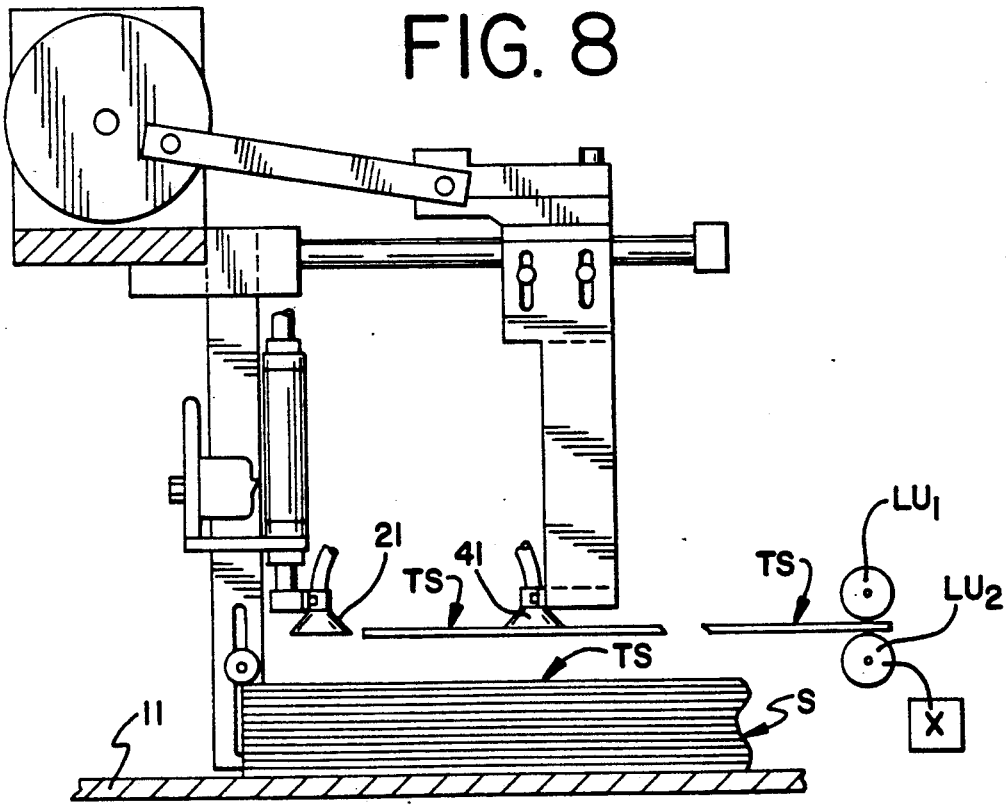

As shown in FIG. 8, one of the entry nip rollers LU2 is connected to a rotary encoder X. The encoder puts out a certain number of pulses with each revolution of the lamination entry roller LU2. In summary, the pulses translate into the distance travelled by a sheet moving between the lamination entry rollers LU1, LU2. The operator merely observes the point where the wheel 63 should be activated and the second suction cups 41 moved from their home, first position to their second position. This point is translated by the operator to a number on the operator's control panel that is set by a thumbwheel switch. A controller (not shown) compares the encoder's pulse number to the operator's thumbwheel switch number. Thus, when the encoder's pulse number matches the operator's thumbwheel switch number, the step motor 61 and wheel member 63 are activated and a new sheet is fed to the lamination unit.

The drop point (where the second vacuum means 42 is switched off to release the top sheet TS) (Step 1 on the time line) is adjustable and set by the operator. Consequently, the sheet can be released by the second suction cups 41 at any point along its path between the home position and the second position.

It should be noted that the step motor 61 and one of the lamination unit's entry nip rollers LU2 are synchronized electrically, such as with pulses, so that the movement of the step motor is tied to the movement of the lamination unit's entry rollers LU1, LU2.

The assembly goes through a six (6) step cycle, which will now be described. It can best be summarized by the following chart:

| Step 1 (Drop sheet) | |
|---|---|
| First suction cups (21) | Second suction cups (41) |
| -move downward | -in forward position |
| First vacuum means (22) | Second vacuum means (42) |
| -turns ON | -turns OFF |

-continued

| | |
|---|---|
| Step 2 | |
| First suction cups (21) -in down position | Second suction cups (41) -move rearward |
| First vacuum means (22) -ON | Second vacuum means (42) -OFF |
| Step 3 | |
| First suction cups (21) -move upward | Second suction cups (41) -move rearward |
| First vacuum means (22) -ON | Second vacuum means (42) -OFF |
| Step 4 | |
| First suction cups (21) -in up position | Second suction cups (41) -in rear (Home) position |
| First vacuum means (22) -ON | Second vacuum means (42) -turns ON |
| Step 5 (WAIT position) | |
| First suction cups (21) -in up position | Second suction cups (41) -in rear (Home) position |
| First vacuum means (22) -turns OFF | Second vacuum means (42) -ON |
| Step 6 | |
| First suction cups (21) -in up position | Second suction cups (41) -move forward |
| First vacuum means (22) -OFF | Second vacuum means (42) -ON |
| Step 1 (Drop sheet) | |
| First suction cups (21) -move downward | Second suction cups (41) -in forward position |
| First vacuum means (22) -turns ON | Second vacuum means (42) -turns OFF |

Means are also provided for switching the first vacuum means 22 ON and OFF and for switching the second vacuum means 42 ON and OFF. In addition, both the first and the second guide means and the switch means are coordinated so that a sheet is gripped by the first suction cups while the first suction cups are in the down position and thereafter while the sheet is moved upwardly by the first suction cups to the second or transfer position. At this juncture, the sheet is next transferred to the second suction cups while the second suction cups are in the first or home position and thereafter moved by the second suction cups to the lamination unit and the second position.

Figure 4:
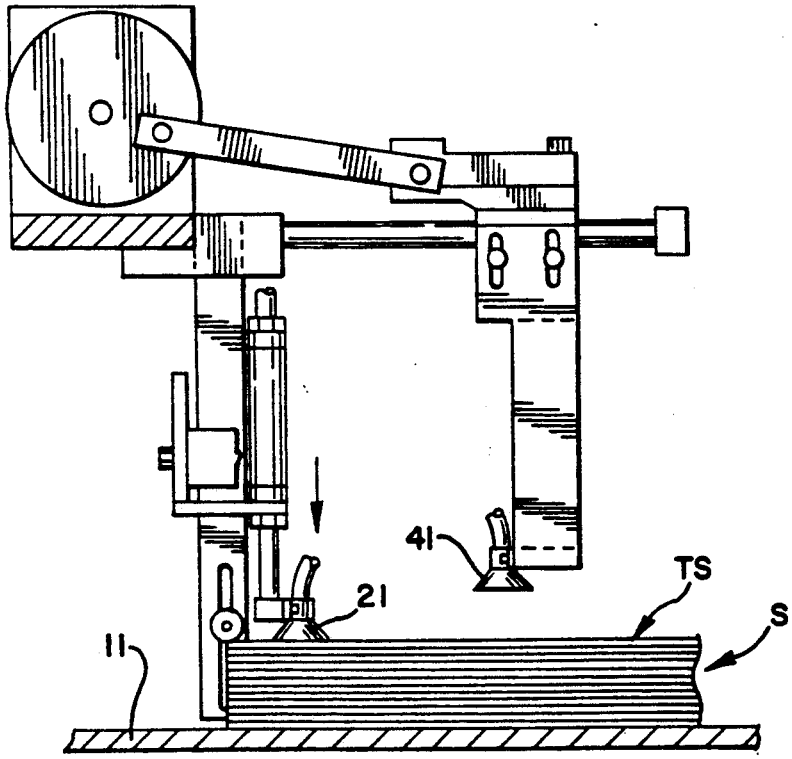
FIGS. 4–8 are schematic views of the steps occurring during the feed of a sheet with the sheet feeding mechanism of the present invention; and, FIG. 9 is a timing diagram of the present invention.

Turning to FIG. 4, once the components of the assembly are initialized, the first suction cups 21 move from their home or up position downwardly towards the exposed top sheet TS of the stack of sheets S while the first vacuum 22 in the first cups is turned ON (Step 1). At the same time, the second suction cups 42 are travelling between their first, home position and their second position.

Once the first cups 21 are near the top sheet TS, they grip it. Meanwhile, the second suction cups 41 continue traveling between their first and second position (Step 2).

Figure 5:
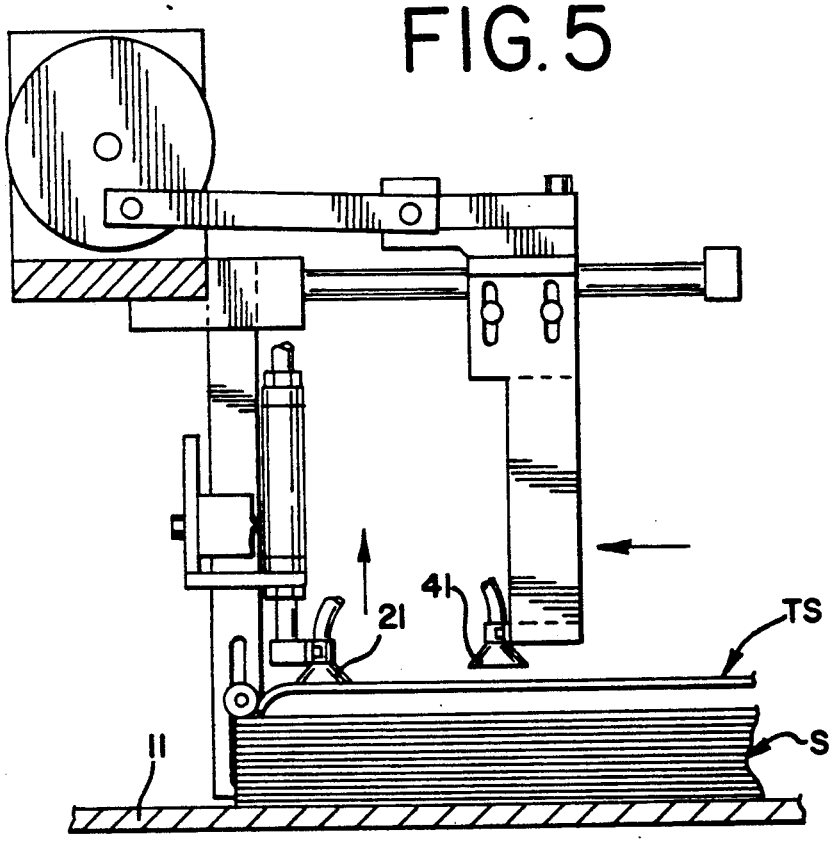

While the second suction cups 41 are moving rearwardly and returning to their first, home position with the second vacuum 42 OFF, the first suction cups 21, with the first vacuum 22 ON and holding the top sheet TS, move upwardly towards the transfer position (Step 3 and FIG. 5).

The first suction cups 21 then arrive at their up, transfer position with the first vacuum means 22 ON and wait for the arrival home of the second suction cups 41. Thereafter, the second suction cups 41 return home. At the instant the second suction cups 41 reach the home position, the sensor 100 (FIG. 1) positioned adjacent the wheel 63 detects the presence of the wheel pin 64*a*. The sensor 100 sends a signal via a wire 101 to the controller to stop the step motor 61. Further, when the second suction cups 41 return home, the second vacuum means 42 turns ON (Step 4 and FIG. 6). For a short period of time (T1) both vacuums 22, 42 are ON and both sets of suction cups 21, 41 are gripping the top sheet TS. This minimizes the possibility of the top sheet TS being dropped in the transfer between the two sets of suction cups 21, 41.

Figure 6:
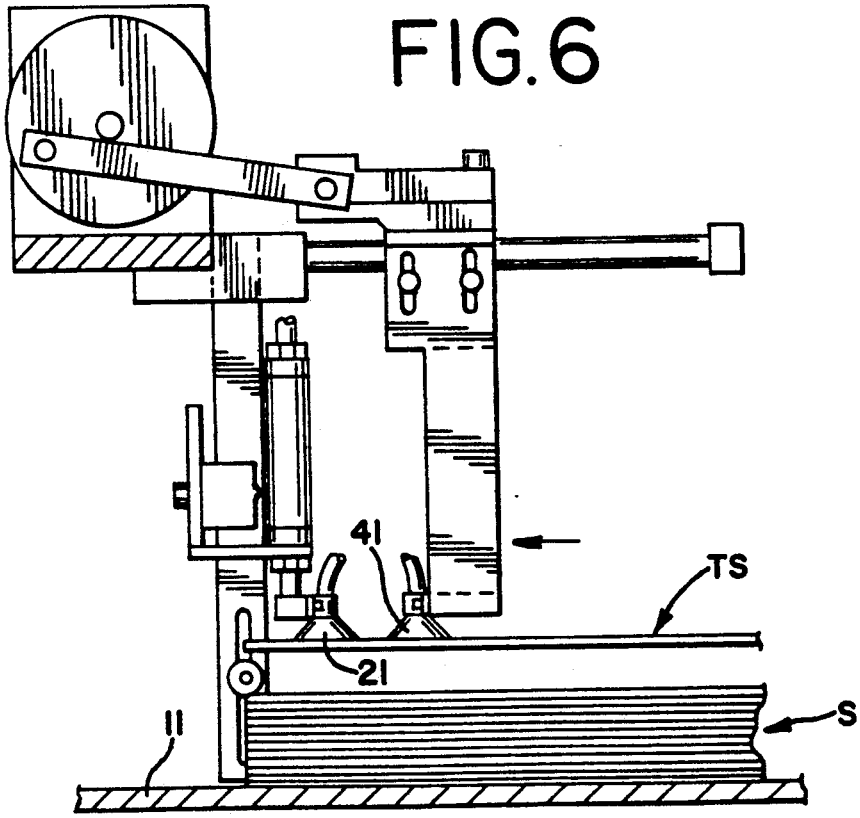
Figure 7:
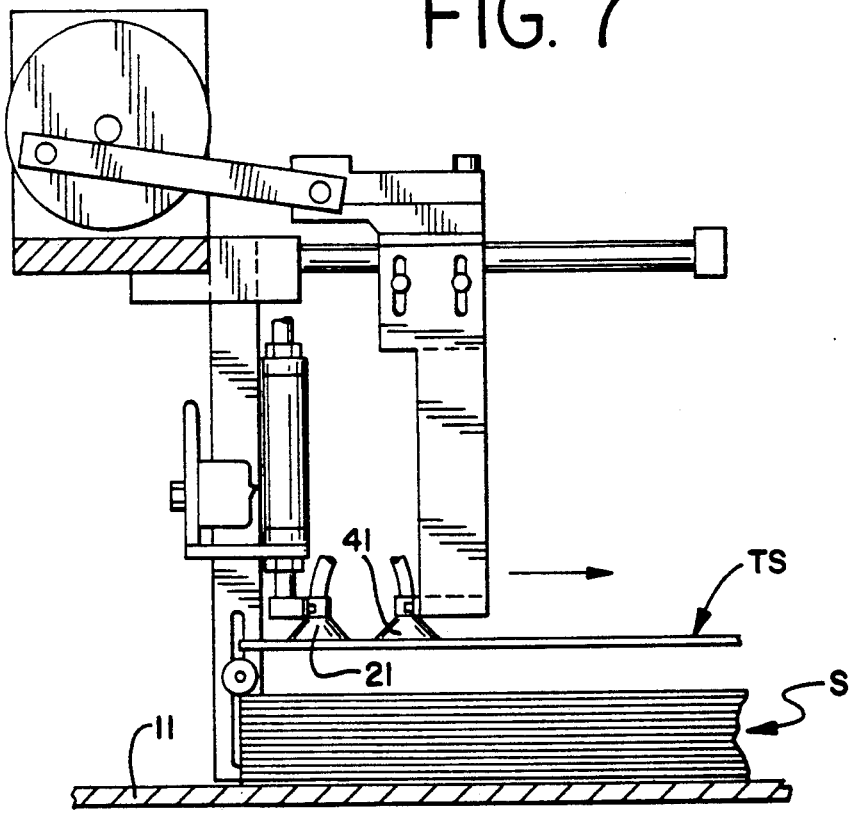

After this brief period of time (T1), the first vacuum 22 is switched OFF so that only the second suction cups 41 are gripping the top sheet TS (FIG. 6).

The WAIT period begins; the step motor 61 is stopped and the second suction cups 41 hold the top sheet TS. This WAIT period occurs every revolution of the wheel member 63. Consequently, every time the wheel member 63 turns 360 degrees, the sensor 100 detects the wheel pin 64*a* and stops the step motor 61. As noted previously, the step motor 61 is activated as soon as the counter's number matches the operator's number. When this number matching occurs, the second suction cups 41 move forwardly towards the lamination unit LU1, LU2 with the second vacuum means 42 ON and holding a sheet TS. The first suction cups 21 remain in the up position with the first vacuum 22 OFF (Step 6 and FIG. 7).

The second suction cups 41 continue forwardly to their second position and release the top sheet TS at their second position or at a point just prior to it, depending on the operator's initial setting (FIG. 8).

The cycle then repeats itself and continues. The second vacuum 42 is switched ON so that the next exposed top sheet TS (originally the second sheet in the stack S) is gripped by the first suction cups 21 which begin to move downwardly (Step 1 and FIG. 4).

A further switch controls the air stream emitted from the air nozzle 82. Specifically, the air stream is on almost the entire cycle. It is turned OFF momentarily at Step 1 at the same time that the first vacuum means 22 is switched ON. The air stream remains OFF during Step 2 so as to not interfere with the pick-up operation of the first suction cups 21. At Step 3, the air in the nozzle 82 is switched ON. Thus, both the vacuum in the first suction cups 21 and the jet stream from the air nozzle 82 are switched ON at about the same time. As made mention previously, this jet stream aids in the separating of the sheets, in the lifting of the top sheet TS by the first gripping member 20 and in the forward movement of the top sheet TS by the second gripping member 40.

It should be noted that in practice, it has been found that the above noted system can be modified to further ensure the integrity of the stack of sheets S and prevent the sheets from undesirably moving. Turning again to FIG. 3, the sensor C is made so that it is L-shaped and has a switch therein. This sensor C has a lip portion and a vertical portion. The vertical portion abuts the front edge of the stack of sheets S while the lip portion abuts the top sheet TS. Consequently, the lip portion of the sensor C acts much the same way as the stop 13 resting adjacent the rear edge of the top sheet TS and prevents the top sheet from undesirably moving.

However, experimentation has shown that while the lip portion of the sensor C prevents unwanted movement of the top sheet TS, it also can, at times, interfere with the proper feeding of a sheet. In short, if the front edge of the top sheet does not completely clear the upper lip portion to the sensor C when the sheet is lifted by the first suction cups 21, the sheet will jam when the second suction cups 41 attempt to move it forward. A simple solution to solve this problem, is locate the transfer, or home, position of the second suction cups 41 at a point a small distance forward of its furthest rearward position. In other words, after the transfer is made of the top sheet TS between the first set of suction cups 21 and the second set of suction cups 41 (Steps 4 and 5 above), the second set of suction cups will continue to move horizontally and rearwardly towards the first suction cups. The distance the second set of suction cups 41 moves is relatively very small and is for the purpose of ensuring that the top sheet TS clears the lip portion of the sensor C. Once the second suction cups 41 have traveled rearwardly this small distance, they reverse their direction and move forwardly (Step 6) towards the front position (where the transfer is made to the lamination unit at Step 1).

It should be noted that while the above system describes the suction cups 21, 41 moving in either horizontal or vertical direction, it is appreciate that the same sheet feeder components can be used to feed sheets along other paths P1, P2 that are neither vertical nor horizontal.

While a specific embodiment has been illustrated and described, numerous modifications come to mind without significantly departing from the spirit of the invention and the scope of protection is only limited by the scope of the accompanying claims.

While the specific embodiments have been illustrated and described, numerous modifications come to mind without significantly departing from the spirit of the invention and the scope of protection is only limited by the scope of the accompanying claims.

We claim:

1. A sheet feeding mechanism comprising:

A) a platform for supporting a stack of sheets with an exposed top sheet;

B) a first suction cup having first vacuum means for holding said top sheet and being movable along a generally vertical path between a first position and a second position in a first direction holding said top sheet and in a second direction without holding said top sheet;

C) first switch means for turning said first vacuum means ON and OFF, said top sheet being held when said first vacuum means is ON;

D) first guide means for supporting and moving said first suction cup along said generally vertical path, said first guide means includes means for driving a fluid cylinder and a generally vertical piston rod connected adjacent one end to said first suction cup and cooperating at said opposite end with said fluid cylinder, said first suction cup being in said first position when said piston rod is extended from said fluid cylinder and said first suction cup being in said second position when said piston rod is retracted into said fluid cylinder;

E) a second suction cup having second vacuum means and being movable along a generally horizontal path between a third position and a fourth position in a first direction holding said top sheet and in a second direction without holding said top sheet;

F) second switch means for turning said second vacuum means ON and OFF, said top sheet being held when said second vacuum means is ON; and, G) second guide means for supporting and moving said second suction cup along said generally horizontal path, said second guide means includes means for driving a rotating member, a link pivotally interconnected adjacent one end to said rotating member defining a rotating member-link interconnection, a generally horizontal stationary guide rod and a reciprocating block slidable on said guide rod pivotally interconnected to said link adjacent the other end of said link, said second suction cup being in said third position when the distance between said rotating member-link interconnection and said guide rod is the greatest and said second suction cup being in said fourth position when said distance between said rotating member-link interconnection and said guide rod is the smallest.

2. The sheet feeder mechanism as defined in claim 1 further including means for adjusting the vertical positioning of said fluid cylinder and means for adjusting the vertical positioning of said second suction cup so.

3. The sheet feeder mechanism as defined in claim 2 further including means for adjusting the horizontal positioning of said reciprocating block and means for adjusting the horizontal positioning of said first cup so as to accommodate sheets of different widths.

4. The sheet feeder mechanism as defined in claim 3 wherein there are at least two horizontally parallel first suction cups, the distance between said cups being adjustable.

5. The sheet feeder mechanism as defined in claim 4 wherein there are at least two horizontally parallel second suction cups.

6. A sheet feeding mechanism comprising:

A) a platform for supporting a stack of sheets with an exposed top sheet;

B) at least two horizontally parallel first suction cups, the distance between said cups being adjustable, having first vacuum means for holding said top sheet and being movable along a generally vertical path between a first position and a second position in a first direction holding said top sheet and in a second direction without holding said top sheet;

C) first switch means for turning said first vacuum means ON and OFF, said top sheet being held when said first vacuum means is ON;

D) first guide means for supporting and moving said first suction cups along said generally vertical path, said first guide means includes means for driving a fluid cylinder and a generally vertical piston rod connected adjacent one end to said first suction cup and cooperating at said opposite end with said fluid cylinder, said first suction cups being in said first position when said piston rod is extended from said fluid cylinder and said first suction cups being in said second position when said piston rod is retracted into said fluid cylinder, E) at least two second suction cups having second vacuum means and being movable along a generally horizontal path between a third position and a fourth position in a first direction holding said top sheet and in a second direction without holding said top sheet;

F) second switch means for turning said second vacuum means ON and OFF, said top sheet being held when said second vacuum means is ON; and, G) second guide means for supporting and moving said second suction cups along said generally horizontal path;

said second guide means includes means for driving a rotating member, a link pivotally interconnected adjacent one end to said rotating member defining a rotating member-link interconnection, a generally horizontal stationary guide rod and a reciprocating block slidable on said guide rod pivotally interconnected to said link adjacent the other end of said link, said second suction cups being in said third position when the distance between said rotating member-link interconnection and said guide rod is the greatest and said second suction cups being in said fourth position when said distance between said rotating member-link interconnection and said guide rod is the smallest;

H) means for adjusting the horizontal positioning of said reciprocating block;

I) means for adjusting the horizontal positioning of said first cup so as to accommodate sheets of different widths;

J) means for adjusting the vertical positioning of said fluid cylinder;

K) means for adjusting the vertical positioning of said second suction cup; and, L) means for coordinating both said switch means and both said guide means so as to perform the following cycle:

1) positioning said first suction cups in said first position with said first vacuum means ON so as to take hold of said exposed top sheet while moving said second suction cups from said fourth position to said third position with said second vacuum means OFF;

2) moving said first suction cups to said second position with said first vacuum means ON so as to be holding said top sheet while moving said second suction cups from said fourth position to said third position with said second vacuum means OFF;

3) positioning said first suction cups in said second position with said first vacuum means ON so as to be holding said top sheet while positioning said second suction cups in said third position with said second vacuum means OFF;

4) turning said first vacuum means OFF so as to release said top sheet from said first suction cups while at about the same time turning said second vacuum means ON so as to have the second suction cups take hold of said top sheet;

5) positioning said first suction cups in said second position with said first vacuum means OFF while moving said second suction cups from said third position to said fourth position with said second vacuum means ON so as to be holding said top sheet;

6) moving said first suction cups from said second position to said first position and turning said first vacuum means ON while positioning said second suction cups in said fourth position and turning said second vacuum means OFF; and, 7) positioning said first suction cups in said first position with said first vacuum means ON so as to take hold of a newly exposed top sheet while moving said second suction cups from said fourth position to said third position with said second vacuum means OFF.

7. A sheet feeding mechanism comprising:

A) a platform for supporting a stack of sheets with an exposed top sheet;

B) a first gripping member having first vacuum means for holding said top sheet and being movable along a generally vertical path between a first position and a second position in a first direction holding said top sheet and in a second direction without holding said top sheet, said first gripping member is at least two horizontally parallel first suction cups, said first suction cups being movable in unison between a first position and a second position and having common first vacuum means connected thereto;

C) first switch means for turning said first vacuum means ON and OFF, said top sheet being held when said first vacuum means is ON;

D) first guide means for supporting and moving said first gripping member along said generally vertical path, said first guide means includes means for driving at least two fluid cylinders and at least two generally vertical piston rods each connected adjacent one end to said one said first suction cup and cooperating at said opposite end with one said fluid cylinder, said first suction cups being in said first position when said piston rods are extended from said fluid cylinders and said first suction cups being in said second position when said piston rods are retracted into said fluid cylinders;

E) a second gripping member having second vacuum means and being movable along a generally horizontal path between a third position and a fourth position in a first direction holding said top sheet and in a second direction without holding said top sheet, said second gripping member is at least two horizontally parallel second suction cups, said second suction cups being movable in unison along a horizontal path between a third position and a fourth position and having common second vacuum means connected thereto;

F) second switch means for turning said second vacuum means ON and OFF, said top sheet being held when said second vacuum means is ON; and, G) second guide means for supporting and moving said second suction cups along said generally horizontal path.

8. The sheet feeder mechanism as defined in claim 7 wherein said second guide means includes means for driving a rotating member, a link pivotally interconnected adjacent one end to said rotating member defining a rotating member-link interconnection, at least two generally horizontal stationary guide rods and a reciprocating block slidable on said guide rods pivotally interconnected to said link adjacent the other end of said link, said second suction cups being in said third position when the distance between said rotating member-link interconnection and said guide rod is the greatest and said second suction cups being in said fourth position when said distance between said rotating member-link interconnection and said guide rods is the smallest.

9. The sheet feeder mechanism as defined in claim 8 further including means for adjusting the vertical positioning of said fluid cylinders and means for adjusting the vertical positioning of said second suction cups.

10. The sheet feeder mechanism as defined in claim 9 further including means for adjusting the horizontal positioning of said reciprocating block and means for adjusting the horizontal positioning of said first cups so as to accommodate sheets of different widths.

11. The sheet feeder mechanism as defined in claim 10 further including means for adjusting the horizontal spacing between said first suction cups.

12. The sheet feeder mechanism as defined in claim 11 further including means for coordinating both said switch means and both said guide means so as to perform the following cycle:

1) positioning said first suction cups in said first position with said first vacuum means ON so as to take hold of said exposed top sheet while moving said second suction cups from said fourth position to said third position with said second vacuum means OFF;

2) moving said first suction cups to said second position with said first vacuum means ON so as to be holding said top sheet while moving said second suction cups from said fourth position to said third position with said second vacuum means OFF;

3) positioning said first suction cups in said second position with said first vacuum means ON so as to be holding said top sheet while positioning said second suction cups in said third position with said second vacuum means OFF;

4) turning said first vacuum means OFF so as to release said top sheet from said first suction cups while at about the same time turning said second vacuum means ON so as to have the second suction cups take hold of said top sheet;

5) positioning said first suction cups in said second position with said first vacuum means OFF while moving said second suction cups from said third position to said fourth position with said second vacuum means ON so as to be holding said top sheet;

6) moving said first suction cups from said second position to said first position and turning said first vacuum means ON while positioning said second suction cups in said fourth position and turning said second vacuum means OFF; and, 7) positioning said first suction cups in said first position with said first vacuum means ON so as to take hold of a newly exposed top sheet while moving said second suction cups from said fourth position to said third position with said second vacuum means OFF.

13. A sheet feeding mechanism comprising:

A) a platform for supporting a plurality of sheets stacked on top of each other;

B) a first suction cup having first vacuum means and being movable along a first path between a first position and a second position;

C) first guide means for supporting and moving said first suction cup along said first path;

D) a second suction cup having second vacuum means and being movable along a second path between a third position and a fourth position;

E) second guide means for supporting and moving said second suction cup along said second path; and, F) switch means for turning said first vacuum means ON and OFF and for turning said second vacuum means OFF and ON.

both said guide means and said switch means being coordinated so that a sheet is gripped by said first suction cup while said first suction cup is in said first position and thereafter moved by said first suction cup to said second position wherein said sheet is transferred to said second suction cup while said second suction cup is in said third position and thereafter moved by said second suction cup to said fourth position, said first suction cup moving from said second position to said first position without gripping a sheet while said second suction cup is moving from said third position to said fourth position with said gripped sheet, said second suction cup moving from said fourth position to said third position without gripping a sheet while said first suction cup is moving from said first position to said second position with said gripped sheet said first guide means includes means for driving a fluid cylinder and a generally vertical piston rod connected adjacent one end to said first suction cup and cooperating at said opposite end with said fluid cylinder, said first suction cup being in said first position when said piston rod is extended from said fluid cylinder and said first suction cup being in said second position when said piston rod is retracted into said fluid cylinder, said second guide means includes means for driving a rotating member, a link pivotally interconnected adjacent one end to said rotating member defining a rotating member-link interconnection, a generally horizontal stationary guide rod and a reciprocating block slidable on said guide rod pivotally interconnected to said link adjacent the other end of said link, said second suction cup being in said third position when the distance between said rotating member-link interconnection and said guide rod is the greatest and said second suction cup being in said fourth position when said distance between said rotating member-link interconnection and said guide rod is the smallest.

14. The sheet feeder mechanism as defined in claim 13 further including means for adjusting the vertical positioning of said fluid cylinder and means for adjusting the vertical positioning of said second suction cup so.

15. The sheet feeder mechanism as defined in claim 14 further including means for adjusting the horizontal positioning of said reciprocating block and means for adjusting the horizontal positioning of said first cup so as to accommodate sheets of different widths.

16. The sheet feeder mechanism as defined in claim 15 wherein there are at least two horizontally parallel first suction cups, the distance between said cups being adjustable.

17. The sheet feeder mechanism as defined in claim 16 wherein there are at least two horizontally parallel second suction cups.

18. A sheet feeding mechanism comprising:

A) a platform for supporting a plurality of sheets stacked on top of each other;

B) at least two horizontally parallel first suction cups, said first suction cups being movable in unison between a first position and a second position and having common first vacuum means connected thereto;

C) first guide means for supporting and moving said first suction cups along said first path;

D) at least two horizontally parallel second suction cups, said second suction cups being movable in unison along a horizontal path between a third position and a fourth position and having common second vacuum means connected thereto;

E) second guide means for supporting and moving said second suction cups along said second path; and, F) switch means for turning said first vacuum means ON and OFF and for turning said second vacuum means OFF and ON, both said guide means and said switch means being coordinated so that a sheet is gripped by said first suction cups while said first suction cups are in said first position and thereafter moved by said first gripping to said second position wherein said sheet is transferred to said second suction cups while said second suction cups are in said third position and thereafter moved by said second suction cups to said fourth position, said first suction cups moving from said second position to said first position without gripping a sheet while said second suction cups are moving from said third position to said fourth position with said gripped sheet, said second suction cups moving from said fourth position to said third position without gripping a sheet while said first suction cups are moving from said first position to said second position with said gripped sheet, said first guide means includes means for driving at least two fluid cylinders and at least two generally vertical piston rods each connected adjacent one end to said one said first suction cup and cooperating at said opposite end with one said fluid cylinder, said first suction cups being in said first position when said piston rods are extended from said fluid cylinders and said first suction cups being in said second positions when said piston rods are retracted into said fluid cylinders.

19. The sheet feeder mechanism as defined in claim 18 wherein said second guide means includes means for driving a rotating member, a link pivotally interconnected adjacent one end to said rotating member defining a rotating member-link interconnection, at least two generally horizontal stationary guide rods and a reciprocating block slidable on said guide rods pivotally interconnected to said link adjacent the other end of said link, said second suction cups being in said third position when the distance between said rotating member-link interconnection and said guide rod is the greatest and said second suction cups being in said fourth position when said distance between said rotating member-link interconnection and said guide rods is the smallest.

20. The sheet feeder mechanism as defined in claim 19 further including means for adjusting the vertical positioning of said fluid cylinders and means for adjusting the vertical positioning of said second suction cups.

21. The sheet feeder mechanism as defined in claim 20 further including means for adjusting the horizontal positioning of said reciprocating block and means for adjusting the horizontal positioning of said first cups so as to accommodate sheets of different widths.

22. The sheet feeder mechanism as defined in claim 21 further including means for adjusting the horizontal spacing between said first suction cups.

23. A method for feeding a sheet comprising the steps of:

A) supporting a plurality of sheets stacked on top of each other;

B) turning a first vacuum means OFF and at about the same time turning a second vacuum means ON;

C) turning said first vacuum means ON and turning said second vacuum means OFF;

D) moving a first gripper member connected to said first vacuum means from a first position to a second position with said first vacuum means ON and from said second position to said first position with said first vacuum means OFF.

said step of moving said first gripping member includes the steps of driving a fluid cylinder having a generally vertical piston rod connected adjacent one end to said first gripping member and cooperating at said opposite end with said fluid cylinder, said first gripping member being in said first position when said piston rod is extended from said fluid cylinder and said first suction cups being in said second position when said piston rod is retracted into said fluid cylinder;

E) moving a second gripper member connected to said second vacuum means from a fourth position to a third position with said second vacuum means OFF and from said third position to said fourth position with said second vacuum means ON, said step of moving said second gripping member includes the steps of driving a rotating member pivotally interconnected with at one end of a link and at the other end pivotally to a reciprocating block slidable on a generally horizontal guide rod, said second gripping member being in said fourth position when the distance between said rotating member-link interconnection and said guide rod is the greatest and said second gripping member being in said third position when said distance between said rotating member-link interconnection and said guide rod is the smallest; and, F) coordinating said vacuums and said gripper members so that a sheet is gripped by said first gripping member while said first gripping member is in said first position and thereafter moved by said first gripping member to said second position wherein said sheet is transferred to said second gripping member while said second gripping member is in said third position, said first gripping member moving from said second position to said first position without gripping a sheet and said second gripping member moving from said fourth position to said third position without gripping a sheet.

24. A method for feeding a sheet comprising the steps of:

1) supporting a stack of sheets with an exposed top sheet;

2) positioning a first gripping member in a first position with a first vacuum means ON so as to take hold of an exposed top sheet while moving a second gripping member from a fourth position to a third position with a second vacuum means OFF, said step of moving said second gripping member includes the steps of driving a rotating member pivotally interconnected with at one end of a link and at the other end pivotally to a reciprocating block slidable on a generally horizontal guide rod, said second gripping member being in said fourth position when the distance between said rotating member-link interconnected and said guide rod is the greatest and said second gripping member being in said third position when said distance between said rotating member-link interconnection and said guide rod is the smallest;

3) moving said first gripping member to said second position with said first vacuum means ON so as to be holding said top sheet while moving said second gripping member from said fourth position to said third position with said second vacuum means OFF, said step of moving said first gripping member includes the steps of driving a fluid cylinder having a generally vertical piston rod connected adjacent one end to said first gripping member and cooperating at said opposite end with said fluid cylinder, said first gripping member being in said first position when said piston rod is extended from said fluid cylinder and said first gripping member being in said second position when said piston rod is retracted into said fluid cylinder;

4) positioning said first gripping member in said second position with said first vacuum means ON so as to be holding said top sheet while positioning said second gripping member in said third position with said second vacuum means OFF;

5) turning said first vacuum means OFF so as to release said top sheet from said first gripping member while at about the same time turning said second vacuum means ON so as to have the second gripping member take hold of said top sheet;

6) positioning said first gripping member in said second position with said first vacuum means OFF while moving said second gripping member from said third position to said fourth position with said second vacuum means ON so as to be holding said top sheet;

7) moving said first gripping member from said second position to said first position and turning said first vacuum means ON while positioning said second gripping member in said fourth position and turning said second vacuum means OFF; and, 8) positioning said first gripping member in said first position with said first vacuum means ON so as to take hold of a newly exposed top sheet while moving said second gripping member from said fourth position to said third position with said second vacuum means OFF.

* * * * *